US005759288A

United States Patent [19]

Young et al.

[11] Patent Number: 5,759,288

[45] Date of Patent: Jun. 2, 1998

[54] WASHING OF DISPERSION NOODLES

[75] Inventors: David John Young, Chorleywood; Edward Charles Glover, London, both of United Kingdom

[73] Assignee: Eastman Kodak Company, Rochester, N.Y.

[21] Appl. No.: 680,741

[22] Filed: Jul. 15, 1996

[30] Foreign Application Priority Data

Aug. 9, 1995 [GB] United Kingdom ..... 9516314

[51] Int. Cl.[6] ..... B08B 9/00

[52] U.S. Cl. ..... 134/25.4; 134/33; 134/34; 134/50; 134/51; 134/53; 134/56 R; 134/64 P; 134/86; 134/94.1; 264/178 R; 264/203; 425/67; 425/382 R; 430/642

[58] Field of Search ..... 134/25.4, 33, 34, 134/50, 51, 53, 56 R, 64 P, 86, 94.1; 264/178 R, 203; 425/67, 382 R; 430/642

[56] References Cited

U.S. PATENT DOCUMENTS

| | | | |
|---|---|---|---|
| 3,396,027 | 8/1968 | McFall et al. | 96/94 |
| 3,589,516 | 6/1971 | Camirand | 210/79 |
| 4,307,055 | 12/1981 | Takeda et al. | 264/178 |

FOREIGN PATENT DOCUMENTS

| | | |
|---|---|---|
| 0 571 902 A2 | 5/1993 | European Pat. Off. . |
| 1 542 322 | 3/1977 | United Kingdom . |
| WO 90/09352 | 8/1990 | WIPO . |

*Primary Examiner*—Laurie Scheiner
*Attorney, Agent, or Firm*—Mark G. Bocchetti

[57] ABSTRACT

It is known to wash dispersion noodles in a 'batchwise' fashion in which the noodles are retained in a kettle or kettle and water is sprayed onto the surface of the noodles. Agitation is achieved by bubbling air into the kettle from the bottom. Described herein is a method and apparatus for continuously washing dispersion noodles. The apparatus includes continuous pipe work in which the noodles are washed, the pipe work including at least one separating device (10) for separating the noodles from the water in which they have been washed. The device (10) comprises a housing (12) having an inlet (14) and an outlet (16). A separating element (22) is located in the housing (12) between the inlet (14) and the outlet (16) and is surrounded by a collection chamber (24), the element (22) comprising a tube of mesh material through which water passes into the collection chamber (24) and which is then drained off through drain (32). The housing (12) includes jets (28, 30) through which water, hot or cold, or steam can be introduced for cleaning the device (10). Water jets (34, 36) are provided in the outlet (16) for introducing clean water to the noodles.

18 Claims, 4 Drawing Sheets

WASHING OF DISPERSION NOODLES

FIELD OF THE INVENTION

The present invention relates to the washing of dispersion noodles, and is more particularly concerned with the washing of noodles comprising photographic dispersions.

BACKGROUND OF THE INVENTION

In photographic dispersions, the oil phase contains a main coupler solvent and almost invariably an auxiliary solvent. The auxiliary solvent is used to improve homogenization, reduce droplet size and facilitate dissolution of the coupler. The auxiliary solvent is water-soluble and can be used in a modest quantity and left in the final dispersion or it can be removed by evaporation under reduced pressure or by washing set noodles of the dispersion in chilled water.

In the last case, that is, washing set noodles of the dispersion, the auxiliary solvent is normally removed by gelling the dispersion by chilling, subdividing the gelled mass into shreds or noodles and then washing the noodles with cold water. This usually involves separate setting and noodling operations and requires considerable space for chill tanks containing the dispersions so that they can be noodled prior to washing, and for the washing itself which can take several hours to complete utilizing many containers.

U.S. Pat. No. 3,396,027 discloses apparatus for producing the noodles from a dispersion. A container containing a dispersion is connected to an extrusion head via a conduit or pipe in which a metering system is provided. The metering system controls the flow of the dispersion through the conduit and increases the supply pressure of the dispersion to the extrusion head. The extrusion head is made of a material which is a poor heat conductor so that cooling of the dispersion therein is avoided. The head is positioned in a vessel containing cold water, the dispersion being extruded into the cold water to form the noodles which are then subsequently washed to remove the unwanted material.

U.S. Pat No. 4,307,055 also discloses extrusion of a dispersion through an extrusion head which comprises a plurality of nozzles to form noodles. As described above, the noodles are extruded into cold water.

GB-A-1 542 322 discloses a method and apparatus for noodling an aqueous colloid dispersion by extruding the dispersion from a plurality of orifices directly into a flow of cooling water at an acute angle to the direction of flow of the water.

Using the method described in GB-A-1 542 322, the noodles are immediately delivered in the water flow via a pipe to a series of kettles. After each kettle is filled, water is supplied thereto for washing the noodles. Agitation of the noodles is also provided. After a predetermined washing time which depends on the concentration of residual auxiliary solvent required in the finished dispersion, the water is drained off and the noodles are melted to form a homogeneous bulk.

PROBLEM TO BE SOLVED BY THE INVENTION

The washing process described above is carried out 'batchwise' and the process is not continuous. This means that additional storage space must be provided for the kettles whilst the noodles are being washed.

The washing process described above also tends not to remove all the surfactant and auxiliary solvent from the dispersion, leaving unpredictable residual levels of these substances in the final material. This is because the noodles can also form mats or clumps which do not wash at the same rate as isolated noodles. This leads to irreproducible washing within a given kettle and also from kettle to kettle. The level of the residual auxiliary solvent in the finished dispersion has an effect on the crystallization tendency of the dispersion on storage and also affects the dye-forming reactivity of the dispersion melt.

Loss of the dispersion material may also occur where 'fines' or small parts of noodle are washed out with the washing water.

Moreover, variations in water flow, noodle weight and washing geometry can also lead to poor reproducibility from one kettle to the next.

If air is used to agitate the noodles, this can cause considerable frothing as surfactant is washed out. This frothing can carry noodles, in particular, the above mentioned 'fines', over the edge of the kettle. This can be an environmental nuisance and a waste of dispersion.

SUMMARY OF THE INVENTION

It is therefore an object of the present invention to provide a method and apparatus for producing fully washed dispersion noodles in a continuous flow.

In accordance with one aspect of the present invention, there is provided a method of continuously washing articles in at least one washing stage, the method comprising the steps of:

a) washing the articles in a stream of washing liquid;

b) substantially separating the articles from the stream of washing liquid;

c) introducing a further stream of washing liquid to the separated articles;

d) passing the articles in the further stream of washing liquid to a further processing stage.

In accordance with a second aspect of the present invention, there is provided a separating device for separating articles from liquid, the device comprising:

a housing having an inlet and an outlet;

at least one separating element mounted within the housing between the inlet and the outlet, each separating element separating articles from liquid; and a collection chamber for collecting the separated liquid, the collection chamber being located between the separating element and the housing.

In one embodiment of the device in accordance with the present invention, the housing comprises an outer tube element in which a single separating element is connected between the inlet and the outlet.

In a further embodiment, the housing comprises a trough in which two separating elements are connected between the inlet and the outlet, the inlet comprising a first inlet portion, a second inlet portion and a valve switchable to connect either one of the first and second inlet portions to receive flow therethrough, and the outlet comprising a first outlet portion and a second outlet portion which are connected together by a manifold portion, the separating elements providing connections between a respective one of the inlet portions and a respective one of the outlet portions.

Advantageously, each separating element comprises a porous tube element. The porous tube element may comprise stainless steel mesh.

The outlet includes jets for introducing clean liquid to the separated articles.

The housing further includes a drain outlet in fluid communication with the collection chamber.

In accordance with a third aspect of the present invention, there is provided a washing system for continuously washing articles, the system comprising a plurality of washing stages, each washing stage including a separating device as described above, wherein the drain outlet from one separating device is connected to supply at least a portion of liquid from that drain outlet to an earlier washing stage of the system.

ADVANTAGEOUS EFFECT OF THE INVENTION

In accordance with the invention, photographic dispersion noodles can be continuously washed in water, separated therefrom, and then passed onto a subsequent treatment stage as a continuous process. This improves the reproducibility within a given batch of dispersion as well as batch-to-batch reproducibility.

One advantage provided by the invention is that less water is used for washing the noodles, and the washing time can be substantially reduced as it is carried out continuously as each noodle is surrounded by flowing washing water. This provides a more efficient system.

In particular, if the washing system includes a plurality of washing stages, water drained from a later stage can be used for washing the noodles in an earlier or previous washing stage.

Furthermore, the levels of residual surfactant and auxiliary solvent remaining in the dispersion are more predictable and can be maintained at acceptable levels.

Moreover, the loss of dispersion due to 'fines' being carried out with the washing water is reduced.

Frothing is reduced as air is not required to agitate the noodles as they are being washed in accordance with the present invention.

BRIEF DESCRIPTION OF THE DRAWINGS

For a better understanding of the present invention, reference will now be made, by way of example only, to the accompanying drawings in which.

DETAILED DESCRIPTION OF THE INVENTION

The term "article" is intended to embrace any item which can be washed in accordance with the method of present invention. Moreover, the term "washing liquid" is used to embrace all liquids which can be used for washing a given article.

The present invention particularly relates to a method for washing photographic dispersion noodles and for allowing the noodles to be separated from the water which is used to wash them. The dispersion noodles are formed by extrusion into a stream of chilled water, the noodles and water being passed to a washing system.

The washing system includes a plurality of washing stages through which the noodles pass. Each washing stage includes a separating device for separating the noodles from used water. Once separated from the used wash water, the noodles can be passed onto a further washing stage with the addition of further clean water to assist in the transportation of the noodles thereto and to effect further washing of the noodles during their passage to the next stage.

Once all washing has been completed, the separated noodles may be passed onto a processing stage where the noodles are melted to form a dispersion melt.

The method of the present invention utilizes a separating device which allows the noodles to proceed while the majority of water in which they are washed runs away through a plurality of small holes formed in internal walls of the device. The separating device may be inclined to the horizontal to optimize the flow rates for the noodles passing through the chamber and for the water being separated therefrom.

Figure 1:
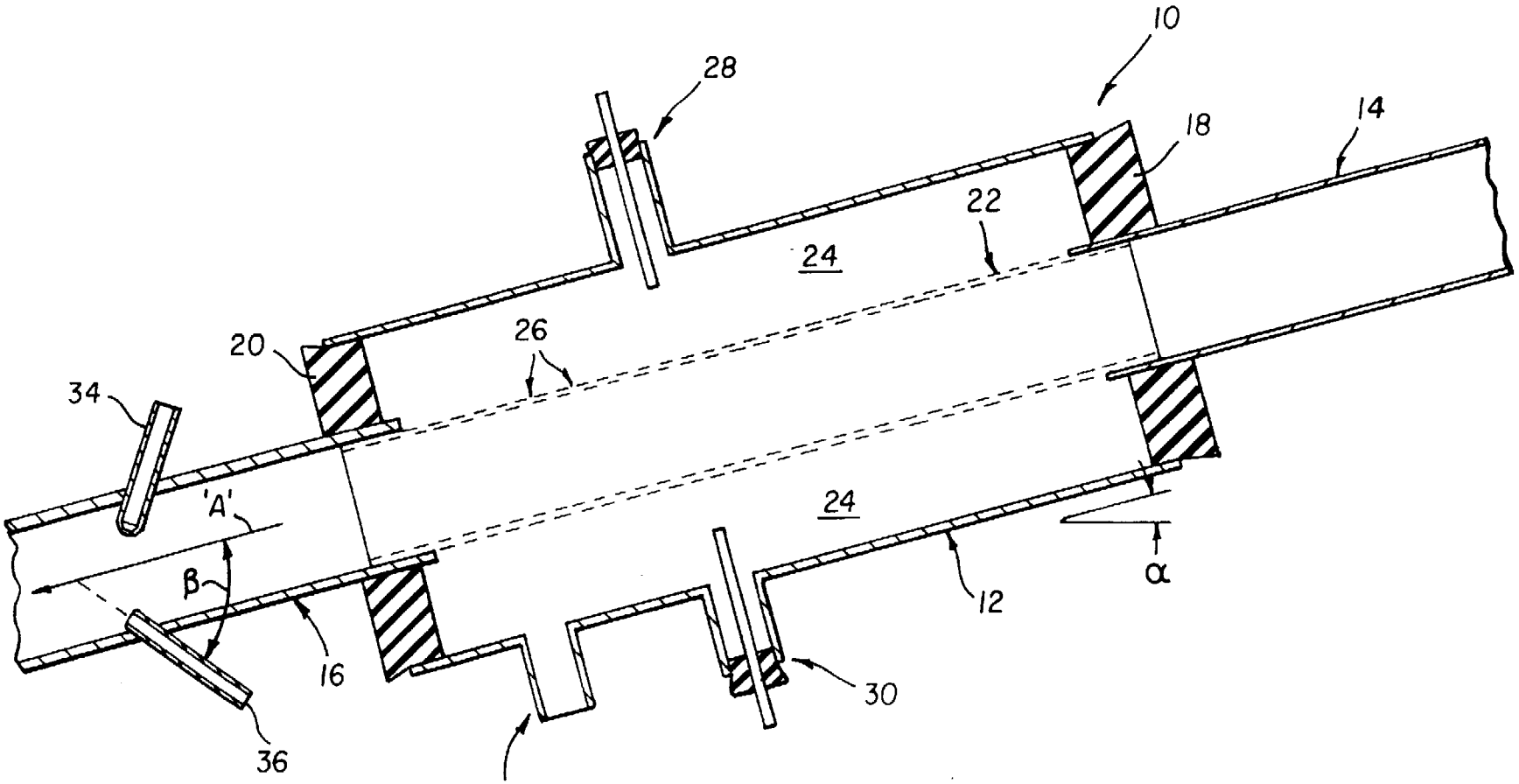
FIG. 1 is a schematic sectioned view of a separating device for separating noodles from water in accordance with the present invention.

FIG. 1 illustrates a separating device 10 in accordance with the present invention. The device 10 comprises an outer tube element 12 connected to an inlet pipe 14 and an outlet pipe 16. Inlet pipe 14 carries noodles in water from an underwater noodler (not shown) or from a previous separating device (also not shown). Outlet pipe 16 is connected to a further separating device (not shown) or to a subsequent stage in an emulsion making process (also not shown). Inlet pipe 14 and outlet pipe 16 may be connected to respective given lengths of pipe which are arranged in a coil in order to save space. Tube element 12 is sealed against the inlet pipe 14 and the outlet pipe 16 at respective ends 18, 20. An inner tube element 22 connects inlet pipe 14 to outlet pipe 16, as shown, and defines an annular chamber 24 with outer tube element 12, inner tube element 22 and ends 18, 20.

Inner tube element 22 has a plurality of holes 26 formed therein through which water can drain into chamber 24. Preferably, inner tube element 22 is made from a mesh material having holes of a predetermined size, for example, stainless steel mesh. Naturally, the holes 26 are sized so as to retain all noodles within the inner tube element 22. The mesh material may have holes formed therein such that there are between 2 to 20 holes/cm (5 to 50 holes/in).

It will be readily appreciated that the mesh may be woven or perforated. The mesh may also be coated with a suitable material to assist the flow of noodles and water through the tube element 22.

Outer tube element 12 optionally includes fluid inlets 28, 30 through which cold water, hot water, or steam can be added to the separating device 10. Fluid inlets 28, 30 can be used for cleaning the device 10. A drain 32 is also provided for removing the water collected in chamber 24.

The device 10 is mounted at an angle $\alpha$ to the horizontal which can be adjusted to optimize the flow of noodles through inner tube element 22 and the flow of water through drain 32. $\alpha$ is chosen to be in the range of 10° to 45°, preferably in the range of 15° to 35°, most preferably, 25°.

Noodles carried in water entering the separating device 10 through inlet 14 are carried therethrough—a greater part of the water being separated therefrom and passing out through drain 32. The noodles are carried along through inner tube element 22 by the remaining water and onto outlet 16.

Water inlets 34, 36 are provided in outlet pipe 16 for supplying fresh water to wash the noodles. Water inlets 34, 36 are arranged to be at an acute angle $\beta$ to the direction of flow of the noodles (indicated by arrow 'A') to assist in their transport to a subsequent stage. $\beta$ can be in the range of 10° to 65°, but an angle of 45° is preferred. The inlets 34, 36 may form part of a spray ring of jets or a double ring of holes through which clean water is introduced into the outlet pipe 16.

Although it is possible to wash the noodles in a single washing stage, it is preferred that the noodles are washed in several stages, and several devices 10 may be employed, each device being connected to the next by means of appropriate pipe work (not shown). Such an arrangement 40 is shown schematically in FIG. 2.

Figure 2:
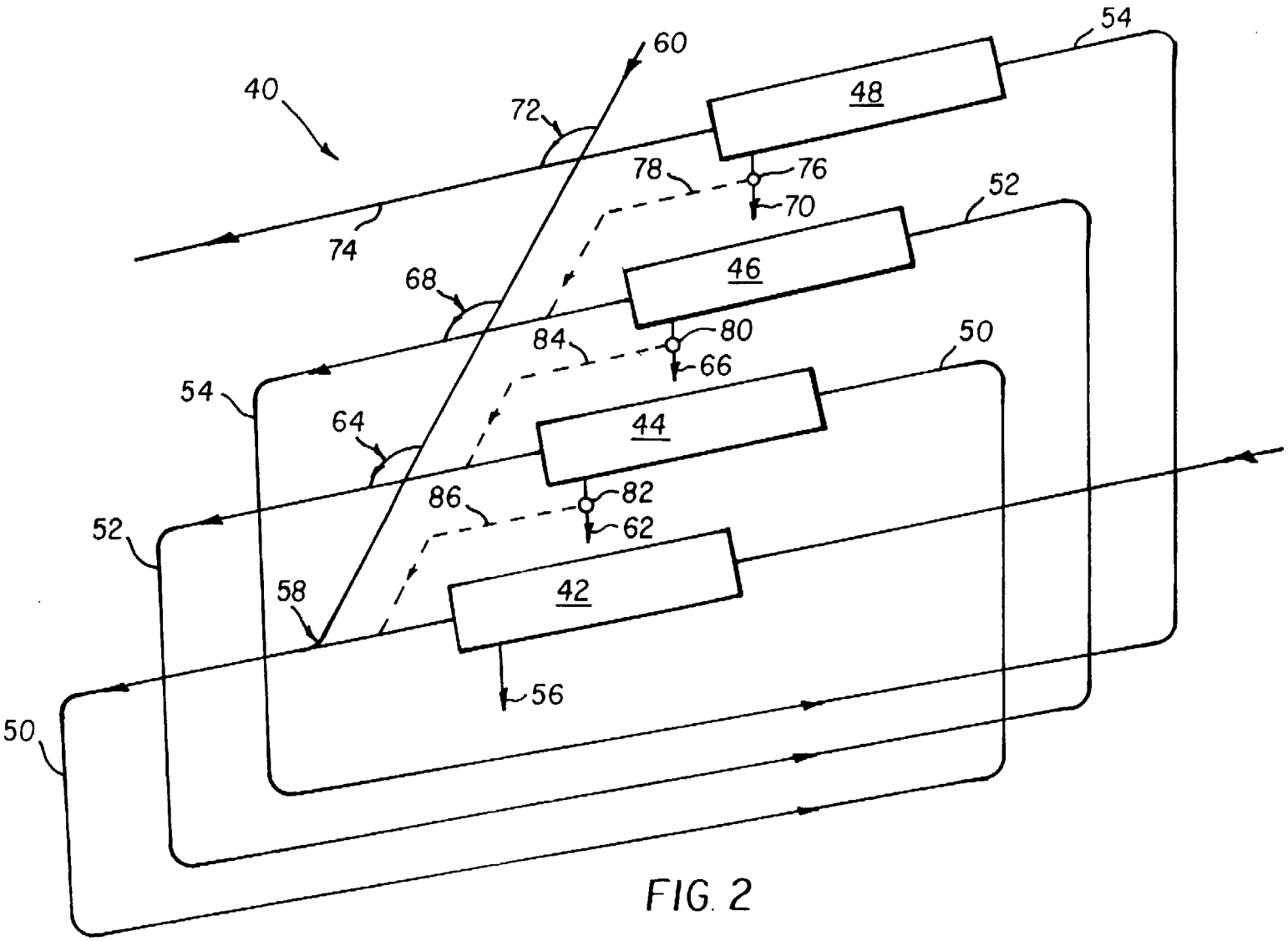
FIG. 2 is a schematic diagram of a washing system utilizing several separating devices as shown in FIG. 1.

In FIG. 2, the arrangement 40 comprises four washing stages and includes four separating devices 42, 44, 46, 48 which are connected together by respective pipes 50, 52, 54. A washing stage may be defined as starting at the end of one separating device and ending at the end of the next adjacent separating device. The optimum residence time for each washing stage depends on the diameter of the pipe work, the flow rate through that stage, the solvent type, in this case, water, and the physical and chemical properties of the noodles being washed.

Unwashed noodles in water enter device 42 (from an underwater noodler (not shown)) where water is removed at drain 56 as described above. Clean water is added to the noodles at 58 from a clean water supply 60 and the noodles leave device 42 along pipe 50 and into device 44. Here, the washing process is repeated—water being removed from drain 62 and the noodles passing along pipe 52 after more clean water is added at 64 to device 46. Water is removed from the noodles in device 46 at drain 66 and clean water added at 68 along pipe 54. The noodles pass along pipe 54 to device 48 where water is taken out at drain 70 and clean water added at 72 along pipe 74 which carries the washed noodles in water to the next stage in the emulsion making process.

Additionally, at least a portion of the water extracted by device 48 at drain 70 can be used to feed backwards to a previous part of the washing system. As shown, a proportioning valve 76 is provided in drain 70 which directs a portion 78 (shown as dotted lines) of the water from that drain to be re-introduced into pipe 54. Water from drain 70 is relatively clean as it is extracted from the last separating device 48 and can be used to wash/transport noodles in a previous part of the washing system.

Similarly, proportioning valves 80, 82, provided in respective drains 66, 62, are used to feed forward a portion of the used water (shown in respective dotted lines 84, 86) to pipes 54, 52 respectively. This has the advantage of reducing the amount of clean water required.

It will be readily appreciated that although only four separating devices 42, 44, 46, 48 are shown in FIG. 2, any number of such devices can be utilized in accordance with the desired amount of washing required for the noodles.

Naturally, drain water only can be added back to the noodles at an earlier washing stage. In this case, there is no need to supply clean water from the supply 60. This has the advantage of cutting down the total amount of water used.

It will also be appreciated that any combination of clean water and drain water from a later washing stage can be used for washing noodles in an earlier washing stage without departing from the present invention.

Figure 3:
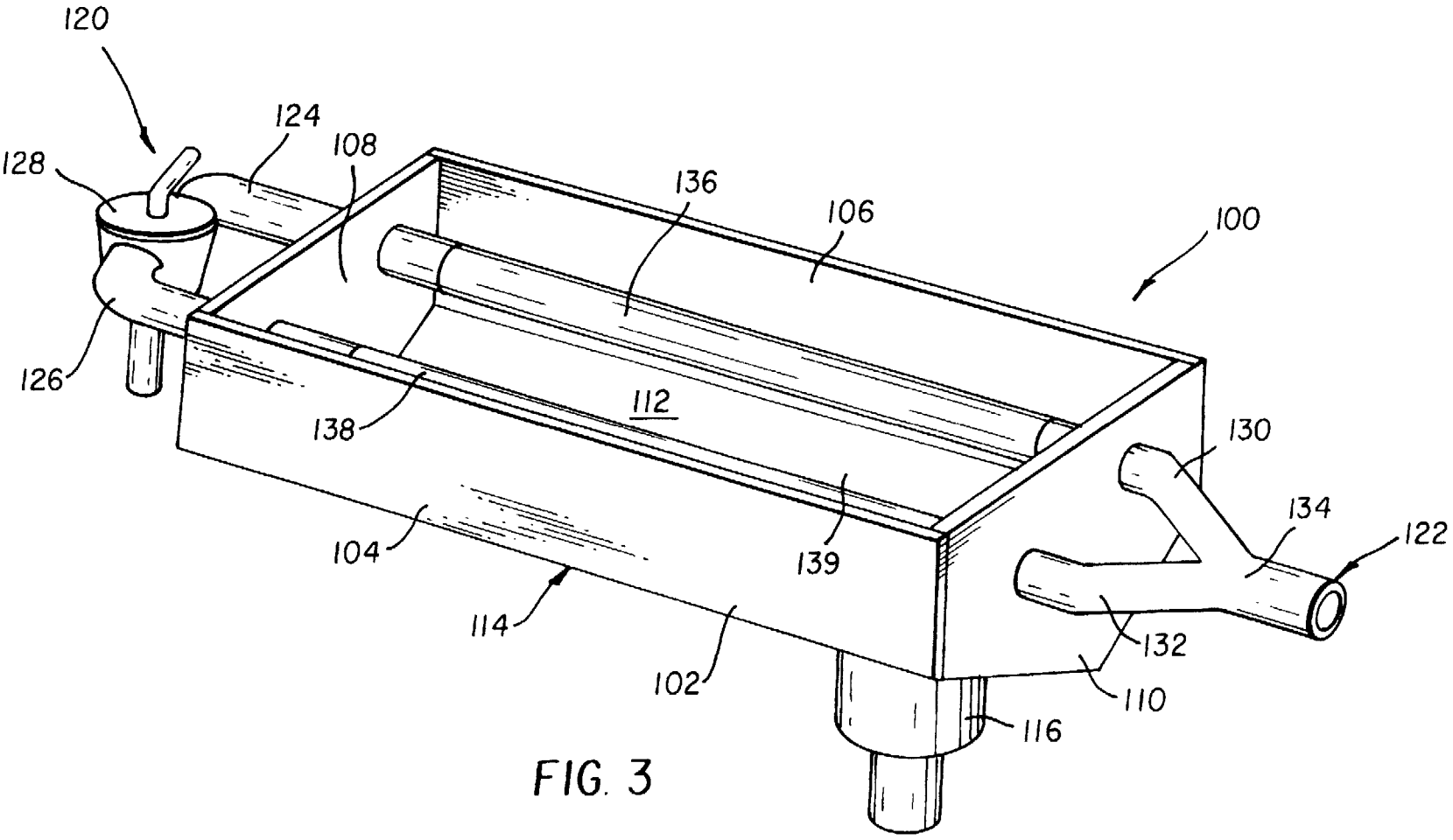
FIG. 3 is a schematic diagram of another washing system utilizing several separating devices as shown in FIG. 1.

FIG. 3 illustrates a further separating device 100 in accordance with the present invention. The device 100 comprises a trough 102 having side walls 104, 106, end walls 108, 110 and bottom walls 112, 114. Bottom walls 112, 114 are arranged to form a general V-shape when a cross-section is taken through the trough 102. A drain 116 is provided in bottom walls 112, 114 as shown.

The device 100 further includes an inlet 120 and an outlet 122. Inlet 120 is formed in end wall 108 and includes two inlet portions 124, 126 and a ball valve 128 which allow flow to be switched between inlet portions 124, 126 as required. Outlet 122 is formed in end wall 110 and includes two outlet portions 130, 132 which are joined together at a manifold portion 134. Inlet portions 124, 126 are connected to a respective one of the outlet portions 130, 132 by two tube elements 136, 138 which are similar to tube element 22 described with reference to FIG. 1.

Noodles to be separated from water are introduced into the device 100 via inlet 120, and are directed into one of the two inlet portions 124, 126 according to the position of the ball valve 128. For example, if the ball valve 128 is normally positioned so that inlet portion 124 receives the noodles, the noodles will then pass along tube element 136 to outlet portion 130 and into manifold portion 134 to outlet 122. Water is separated from the noodles by the tube element 136, the separated water falling into lower portion 139 of the trough 102 which is connected to the drain 116. In this case, tube element 138 is a standby element and will be used if tube element 136 becomes blocked.

If tube element 136 becomes blocked, ball valve 128 is operated to switch the flow of noodles and water into inlet portion 126, through tube element 138 into outlet portion 132 and then into manifold portion 134 to outlet 122. Tube element 136 can then be unblocked and left as the standby tube element until there is a problem with tube element 138 when the ball valve 128 will be switched over again so that the flow of noodles and water is through inlet portion 124, tube element 136, outlet portion 130 and into manifold portion 134 to outlet 122.

Additionally, a pressure relief valve or temporary expansion chamber (not shown) may be provided in the associated pipe work to reduce the effect of a blockage until the ball valve 128 is switched over to allow the flow of noodles in water to continue.

When the noodles finally exit the washing stage, they can be drained completely, melted and passed to finishing kettles or to cans for chilling. This is shown schematically in FIG. 4.

Figure 4:
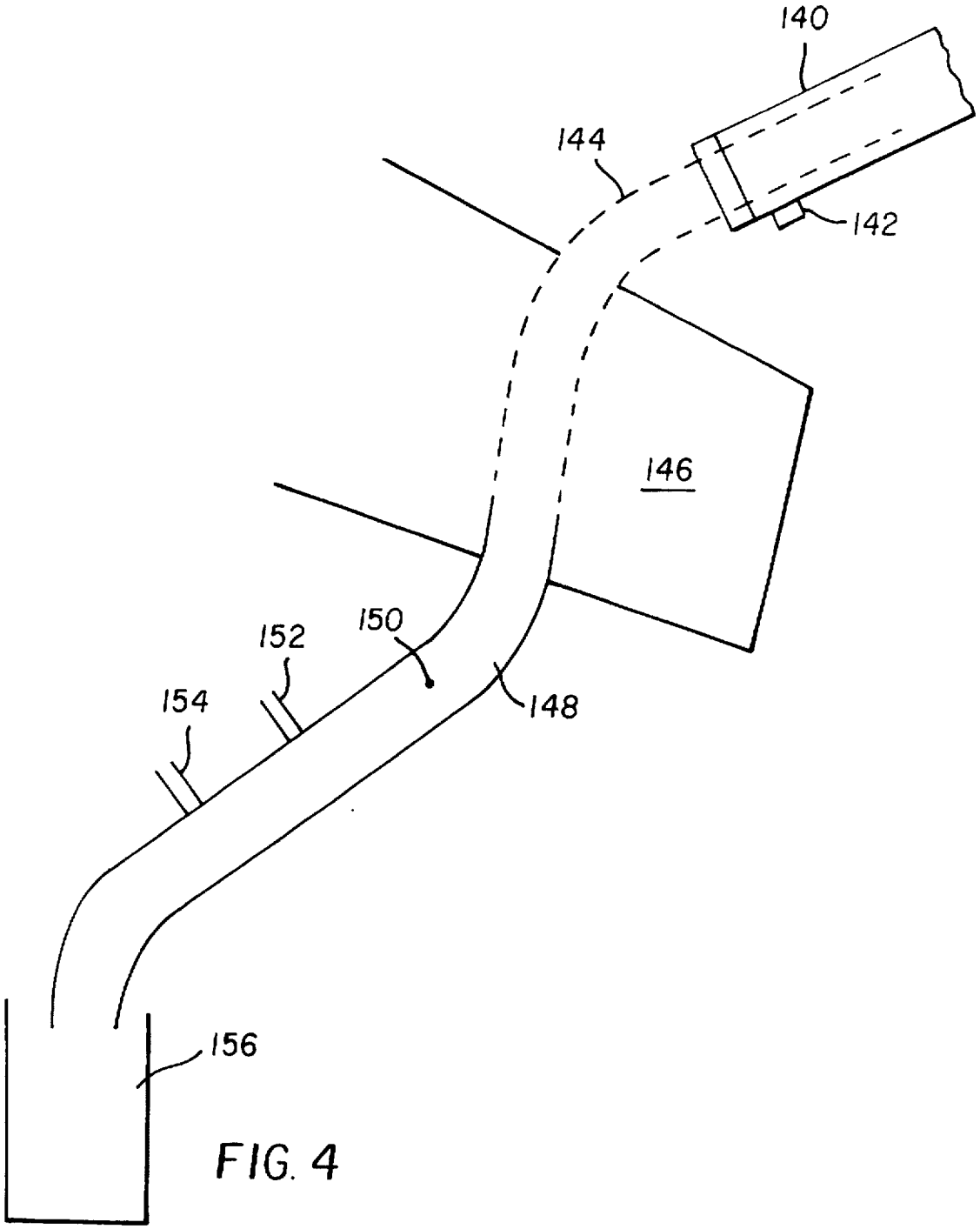
FIG. 4 is a schematic diagram of a continuous melting arrangement to which a washing system in accordance with the present invention can be attached for feeding washed noodles thereto.

In FIG. 4, a portion of a final separating device 140 is shown having a drain 142 as described above. However, outlet pipe 144 is not solid and allows further water to be drained from the noodles before they pass on to a heating stage 146 where they are heated to form a melt. Once formed, the melt passes through a conduit 148 in which an electrode 150 is located for measuring the pH of the melt. pH adjusting solution can be introduced into the conduit 148 as required at inlet 152 to adjust the pH of the melt to the correct value. A further inlet 154 is provided through which bacteristat can be added prior to the melt being passed to a can 156 for chilling.

It will be readily appreciated that the noodles will be washed as they are transported in pipe work between adjacent separating devices of a given washing system. This is due to the swirling and tumbling motion of the water within the pipe work.

Although the pipes connecting the separating devices in FIGS. 2 and 3 are shown as single looped lines, the pipes may be coiled depending on the path length required between separating devices. For example, the pipes may be coiled and stacked so that there are three concentric coils of differing diameter in each layer of the stack.

It is an advantage if the pipes connecting the separating devices are at least translucent, preferably, transparent, so that it is possible to view the noodles in water as they are washed to check that they are tumbling etc. For example, the pipes may be made of glass, but this will result in a rather fragile washing system. PVC is a suitable material for the pipes. However, any other suitable polymeric material may be used. In the example to be described, the pipes were made of PVC and reinforced by having a spiral formed within the wall of the pipe itself.

EXAMPLE

Comparative experiments were carried out using conventional kettle washing techniques and continuous washing in accordance with the present invention for nine different photographic dispersions (A, B, C, D, E, F, G, H and I) in the form of noodles. The noodles were extruded at a rate of between 9 l/min and 10 l/min into a stream of chilled water flowing at a rate of approximately 50 l/min using a conventional underwater noodler (not shown), the total flow rate of the noodles and water being around 60 l/min.

The dispersions were cyan, magenta and yellow coupler dispersions. Dispersions A, B, C, F, G, H and I each had a known percentage of one auxiliary solvent, 2-(2'-butoxyethoxy)ethyl acetate. Similarly, dispersions D and E each had a known percentage of two different auxiliary solvents, namely, triethyl phosphate and cyclohexanone, respectively.

One batch of each dispersion was directed to a kettle for washing using conventional kettle washing techniques. Each batch was washed for a time in accordance with what was the norm for that particular dispersion. The average residual auxiliary solvent was measured after the washing time and expressed as a percentage of the original auxiliary solvent concentration.

In a second batch of dispersions, each batch was fed directly from the underwater noodler to a washing system in accordance with the present invention. The washing system used comprised six washing stages, each stage having a separating device as described above. As will be readily appreciated, the flow rate of the noodles in water as it passed through the first stage of the washing system was around 60 l/min. After the first stage had separated out the water, clean water was added at a rate of 20 l/min, making the total flow rate around 30 l/min. Again, the average residual auxiliary solvent was measured after a predetermined washing time and expressed as a percentage of the original auxiliary solvent concentration. The results obtained are shown in Table 1.

TABLE 1

| | | KETTLE WASHING | | | CONTINUOUS WASHING | | |
|---|---|---|---|---|---|---|---|
| DISPERSION | INITIAL AUXILIARY SOLVENT* CONC. (%) | TIME (HOURS) | AVERAGE RESIDUAL AUXILIARY SOLVENT (%) | RESIDUAL AS % OF ORIGINAL SOLVENT CONC. | TIME (HOURS) | AVERAGE RESIDUAL AUXILIARY SOLVENT (%) | RESIDUAL AS % OF ORIGINAL SOLVENT CONC. |
| A | 14.5 | 4 | 0.18 | 1.24 | 2.25 | 0.14 | 0.96 |
| B | 3.5 | 3 | 1.05 | 30.00 | 2.25 | 1.07 | 30.57 |
| C | 13.5 | 5 | 0.05 | 0.37 | 2.25 | 0.26 | 1.92 |
| D | 6.6 | 4 | nil# | — | 2.25 | nil | — |
| E | 12.4 | 6 | 0.02+ | 0.16 | 2.25 | 0.02 | 0.16 |
| F | 15.1 | 8 | 0.02 | 0.13 | 1.7 | 0.12 | 0.79 |
| G | 3.6 | 5 | 0.12 | 3.33 | 1.3 | 0.15 | 4.17 |
| H | 9.7 | 6 | n/a | — | 1.75 | 0.05 | 0.51 |
| I | 14.0 | 6 | 0.2 | 0.14 | 1.6 | 0.19 | 1.36 |

*2-(2'-butoxyethoxy) ethyl acetate
#triethyl phosphate
+cyclohexanone

Although the present invention has been described with reference to the washing of photographic dispersion noodles in water, it will be readily understood that the present invention is not limited to the washing of such materials.

Suitable control devices (not shown) may be employed to control the operation of a washing system incorporating separating devices in accordance with the present invention. Naturally, at least one pump is required to draw noodles in water through the washing system.

It is important that a suitable pump is chosen as the noodles may be destroyed as they are drawn through the washing system. In the example described above, peristaltic pumps were employed.

It will be appreciated that the present invention is not limited to the removal of water soluble auxiliary solvent by washing dispersion noodles in water. Any other unwanted water soluble substance can also be removed. For example, water soluble surfactant materials may be removed from the dispersion noodles at the same time as the auxiliary solvent.

It may be possible to extend the washing system of the present invention to photographic emulsion noodles, that is, silver halide in a gelatin dispersion. However, it will be readily appreciated that such a system would need to be light-tight or operate in a dark room due to the photosensitive nature of silver halide materials.

Air may become entrained in the washing system at the separating devices. Suitable means may be provided to allow such entrained air to be removed from the flow.

It may also be possible to recover auxiliary solvent from the used wash water separated from the noodles at the earlier washing stages of a washing system in accordance with the present invention. It will be readily understood that this wash water will contain the highest level of auxiliary solvent.

We claim:

1. A method for washing photographic dispersion noodles comprising the steps of:

(a) transporting a continuous flow of photographic dispersion noodles and a liquid solvent to a porous tube element;

(b) continuously separating a substantial portion of the liquid solvent from the continuous flow in the porous tube element;

(c) transporting the continuous flow of photographic dispersion noodles from the porous tube element through an outlet conduit;

(d) introducing a stream of additional liquid solvent into the outlet conduit to combine with the continuous flow of dispersion noodles to thereby create a combined flow;

(e) continuously passing the combined flow to a further processing stage.

2. A method as recited in claim 1 further comprising the steps of:

(a) containing in a collection chamber the substantial portion of liquid solvent separated from the continuous flow in said separating step;

(b) continuously draining liquid solvent from the collection chamber.

3. A method as recited in claim 1 further comprising the steps of:

(a) transporting a continuous flow of photographic dispersion noodles and a liquid solvent to a porous tube element;

(b) continuously separating a substantial portion of the liquid solvent from the continuous flow in the porous tube element;

(c) transporting the continuous flow of photographic dispersion noodles from the porous tube element through an outlet conduit;

(d) introducing a stream of additional liquid solvent into the outlet conduit to combine with the continuous flow of dispersion noodles to thereby create a combined flow;

(e) continuously passing the combined flow to a further processing stage.

4. A method as recited in claim 2 further comprising the steps of:

repeating steps (a) through (e) of claim 1.

5. A method as recited in claim 1 wherein:

the liquid solvent is water.

6. An apparatus for washing photographic dispersion noodles comprising:

(a) a housing;

(b) an inlet conduit for transporting photographic dispersion noodles and a liquid solvent to said housing;

(c) at least one porous tube element residing within said housing connected to said inlet conduit, said housing forming a collection chamber between an inner surface thereof and an outer surface of said at least one porous tube element, said collection chamber capturing the liquid solvent which passes through said at least one porous tube element;

(d) an outlet conduit connected to said at least one porous tube element for transporting photographic dispersion noodles and a reduced amount of liquid solvent from said housing;

(e) a drain connected to said housing allowing for the removal of the liquid solvent from said collection chamber.

7. An apparatus as recited in claim 6 wherein:

said housing is an outer tube element enclosing said at least one porous tube element.

8. An apparatus as recited in claim 6 wherein:

said housing is a trough and there are at least two of said porous tube elements residing therein, each of said porous tube elements having an inlet portion and an outlet portion.

9. An apparatus as recited in claim 8 further comprising:

(a) a first manifold connecting said inlet portions of said porous tube elements;

(b) a second manifold connecting said outlet portions of said porous tube elements;

(c) a valve connected to said first manifold, said valve being switchable to allow flow through any one of said at least two porous tube elements while simultaneously blocking flow to the other of said at least two porous tube elements.

10. An apparatus as recited in claim 6 further comprising:

at least one fluid inlet into said housing directed at said outer surface of said at least one porous tube element for cleaning said at least one porous tube element with a pressurized fluid.

11. An apparatus as recited in claim 6 wherein:

said at least one porous tube element is comprised of stainless steel mesh.

12. An apparatus as recited in claim 6 wherein:

said apparatus is positioned to lie at an angle in the range of from about 10° to about 45° from the horizontal.

13. An apparatus as recited in claim 12 wherein:

said apparatus is positioned to lie at an angle of about 25° from the horizontal.

14. An apparatus as recited in claim 6 wherein:

said apparatus includes multiple washing stages connected to each other in series, each of said washing stages including elements (a) through (e).

15. An apparatus as recited in claim 6 further comprising:

(a) a second housing;

(b) a second inlet conduit for transporting photographic dispersion noodles and a liquid solvent to said second housing, said second inlet conduit connected to said outlet conduit;

(c) at least one porous tube element residing within said second housing connected to said second inlet conduit, said second housing forming a second collection chamber between an inner surface thereof and an outer surface of said at least one porous tube element within said second housing, said second collection chamber capturing the liquid solvent which passes through said at least one porous tube element;

(d) a second outlet conduit connected to said at least one porous tube element within said second housing for transporting photographic dispersion noodles and a reduced amount of liquid solvent from said second housing;

(e) a second drain connected to said second housing allowing for the removal of the liquid solvent from said second collection chamber.

16. An apparatus as recited in claim 14 wherein:

a portion of the liquid solvent drained through said drain of a downstream one said washing stages is transmitted to an upstream one of said washing stages.

17. An apparatus as recited in claim 6 wherein:

said liquid solvent is water.

18. An apparatus as recited in claim 6 further comprising:

at least one solvent inlet into said outlet conduit.

* * * * *